US006438896B1

(12) United States Patent
Weder et al.

(10) Patent No.: US 6,438,896 B1
(45) Date of Patent: Aug. 27, 2002

(54) METHOD OF COVERING A POT OR FLORAL GROUPING WITH A SLEEVE HAVING A ROUNDED LOWER END

(75) Inventors: Donald E. Weder; Joseph G. Straeter, both of Highland, IL (US); Paul Fantz, Imperial, MO (US)

(73) Assignee: Southpac Trust International, Inc.

( * ) Notice: Subject to any disclaimer, the term of this patent is extended or adjusted under 35 U.S.C. 154(b) by 0 days.

(21) Appl. No.: 09/848,161

(22) Filed: May 3, 2001

Related U.S. Application Data

(63) Continuation-in-part of application No. 09/401,771, filed on Sep. 22, 1999, now Pat. No. 6,230,441, which is a continuation of application No. 08/606,957, filed on Feb. 26, 1996, now abandoned.

(51) Int. Cl.[7] ..... A47G 7/08
(52) U.S. Cl. ..... 47/72; 53/397
(58) Field of Search ..... 47/72; 206/423; 53/397, 399

(56) References Cited

U.S. PATENT DOCUMENTS

| | | | | |
|---|---|---|---|---|
| 524,219 | A | 8/1894 | Schmidt | |
| 732,889 | A | 7/1903 | Paver | |
| 950,785 | A | 3/1910 | Pene | |
| 1,044,260 | A | 11/1912 | Schloss | |
| 1,063,154 | A | 5/1913 | Bergen | |
| 1,446,563 | A | 2/1923 | Hughes | |
| 1,520,647 | A | 12/1924 | Hennigan | |
| 1,525,015 | A | 2/1925 | Weeks | |
| 1,610,652 | A | 12/1926 | Bouchard | |
| 1,697,751 | A | 1/1929 | Blake | 229/87 |
| 1,794,212 | A | 2/1931 | Snyder | |
| 1,811,574 | A | 6/1931 | Barrett | |
| 1,863,216 | A | 6/1932 | Wordingham | |
| 1,978,631 | A | 10/1934 | Herrlinger | 91/68 |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 345464 | 12/1921 |
| DE | 513971 | 11/1930 |
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |

(List continued on next page.)

OTHER PUBLICATIONS

Speed Cover Brochure, "The Simple Solution For Those Peak Volume Periods", Highland Supply Corporation, ©1989.

(List continued on next page.)

*Primary Examiner*—Peter M. Poon
*Assistant Examiner*—Jeffrey L. Gellner
(74) *Attorney, Agent, or Firm*—Dunlap, Codding & Rogers, P.C.

(57) ABSTRACT

A floral sleeve initially having a flattened condition and openable therefrom for use in covering, containing or wrapping a floral grouping, botanical item, pot, or pot having a floral grouping or botanical item therein. The sleeve has a rounded lower end, and may have a detachable upper portion. The sleeve may have a non-linear or linear upper edge. When having a detachable upper portion, the sleeve has a detaching element which when employed to detach the upper portion, leaves a linear, or non-linear upper edge on the lower portion of the sleeve. The rounded lower end of the sleeve may have a gusset therein.

21 Claims, 4 Drawing Sheets

U.S. PATENT DOCUMENTS

| | | | | |
|---|---|---|---|---|
| 2,048,123 | A | 7/1936 | Howard | 229/87 |
| RE21,065 | E | 5/1939 | Copeman | 93/2 |
| 2,170,147 | A | 8/1939 | Lane | 206/56 |
| 2,200,111 | A | 5/1940 | Bensel | 229/1.5 |
| 2,278,673 | A | 4/1942 | Savada et al. | 154/43 |
| 2,302,259 | A | 11/1942 | Rothfuss | 41/10 |
| 2,323,287 | A | 7/1943 | Amberg | 229/53 |
| 2,355,559 | A | 8/1944 | Renner | 229/8 |
| 2,371,985 | A | 3/1945 | Freiberg | 206/46 |
| 2,411,328 | A | 11/1946 | MacNab | 33/12 |
| 2,510,120 | A | 6/1950 | Leander | 117/122 |
| 2,529,060 | A | 11/1950 | Trillich | 117/68.5 |
| 2,621,142 | A | 12/1952 | Wetherell | 154/117 |
| 2,648,487 | A | 8/1953 | Linda | 229/55 |
| 2,688,354 | A | 9/1954 | Berger | 150/28 |
| 2,774,187 | A | 12/1956 | Smithers | 47/41 |
| 2,822,287 | A | 2/1958 | Avery | 117/14 |
| 2,846,060 | A | 8/1958 | Yount | 206/58 |
| 2,850,842 | A | 9/1958 | Eubank, Jr. | 47/58 |
| 2,883,262 | A | 4/1959 | Borin | 21/56 |
| 2,989,828 | A | 6/1961 | Warp | 53/390 |
| 3,022,605 | A | 2/1962 | Reynolds | 47/58 |
| 3,080,680 | A | 3/1963 | Reynolds | 47/37 |
| 3,094,810 | A | 6/1963 | Kalpin | 47/37 |
| 3,121,647 | A | 2/1964 | Harris et al. | 118/202 |
| 3,130,113 | A | 4/1964 | Silman | 161/97 |
| 3,271,922 | A | 9/1966 | Wallerstein et al. | 53/3 |
| 3,322,325 | A | 5/1967 | Bush | 229/62 |
| 3,376,666 | A | 4/1968 | Leonard | 47/41 |
| 3,380,646 | A | 4/1968 | Doyen et al. | 229/57 |
| 3,431,706 | A | 3/1969 | Stuck | 53/390 |
| 3,508,372 | A | 4/1970 | Wallerstein et al. | 53/3 |
| 3,510,054 | A | 5/1970 | Sanni et al. | 229/66 |
| 3,512,700 | A | 5/1970 | Evans et al. | 229/53 |
| 3,550,318 | A | 12/1970 | Remke et al. | 47/37 |
| 3,552,059 | A | 1/1971 | Moore | 47/41.12 |
| 3,554,434 | A | 1/1971 | Anderson | 229/55 |
| 3,556,389 | A | 1/1971 | Gregoire | 229/53 |
| 3,557,516 | A | 1/1971 | Brandt | 53/14 |
| 3,620,366 | A | 11/1971 | Parkinson | 206/59 |
| 3,681,105 | A | 8/1972 | Milutin | 117/15 |
| 3,767,104 | A | 10/1973 | Bachman et al. | 229/7 |
| 3,793,799 | A | 2/1974 | Howe | 53/32 |
| 3,869,828 | A | 3/1975 | Matsumoto | 47/34.11 |
| 3,888,443 | A | 6/1975 | Flanigen | 248/152 |
| 3,962,503 | A | 6/1976 | Crawford | 428/40 |
| 4,043,077 | A | 8/1977 | Stonehocker | 47/66 |
| 4,054,697 | A | 10/1977 | Reed et al. | 428/40 |
| 4,091,925 | A | 5/1978 | Griffo et al. | 206/423 |
| 4,113,100 | A | 9/1978 | Soja et al. | 206/602 |
| 4,118,890 | A | 10/1978 | Shore | 47/28 |
| 4,189,868 | A | 2/1980 | Tymchuck et al. | 47/84 |
| 4,216,620 | A | 8/1980 | Weder et al. | 47/72 |
| 4,248,347 | A | 2/1981 | Trimbee | 206/423 |
| D259,333 | S | 5/1981 | Charbonneau | D9/306 |
| 4,265,049 | A | 5/1981 | Gorewitz | 47/26 |
| 4,280,314 | A | 7/1981 | Stuck | 53/241 |
| 4,297,811 | A | 11/1981 | Weder | 47/72 |
| 4,333,267 | A | 6/1982 | Witte | 47/84 |
| 4,347,686 | A | 9/1982 | Wood | 47/73 |
| 4,380,564 | A | 4/1983 | Cancio et al. | 428/167 |
| 4,400,910 | A | 8/1983 | Koudstall et al. | 47/84 |
| 4,413,725 | A | 11/1983 | Bruno et al. | 206/45.33 |
| D279,279 | S | 6/1985 | Wagner | D11/143 |
| 4,546,875 | A | 10/1985 | Zweber | 206/82 |
| 4,621,733 | A | 11/1986 | Harris | 206/423 |
| 4,640,079 | A | 2/1987 | Stuck | 53/390 |
| 4,717,262 | A | 1/1988 | Roen et al. | 383/120 |
| 4,733,521 | A | 3/1988 | Weder et al. | 53/580 |
| 4,765,464 | A | 8/1988 | Ristvedt | 206/82 |
| 4,771,573 | A | 9/1988 | Stengel | 47/67 |
| 4,773,182 | A | 9/1988 | Weder et al. | 47/72 |
| 4,801,014 | A | 1/1989 | Meadows | 206/423 |
| 4,810,109 | A | 3/1989 | Castel | 383/105 |
| 4,835,834 | A | 6/1989 | Weder | 29/525 |
| D301,991 | S | 7/1989 | Van Sant | D11/149 |
| 4,914,860 | A * | 4/1990 | Richardson | 47/72 |
| 4,941,572 | A | 7/1990 | Harris | 206/423 |
| 4,980,209 | A | 12/1990 | Hill | 428/34.1 |
| 4,989,396 | A | 2/1991 | Weder et al. | 53/397 |
| D315,700 | S | 3/1991 | Stephens | D11/151 |
| 5,073,161 | A | 12/1991 | Weder et al. | 493/154 |
| 5,074,675 | A | 12/1991 | Osgood | 383/122 |
| 5,105,599 | A | 4/1992 | Weder | 53/399 |
| 5,111,638 | A | 5/1992 | Weder | 53/397 |
| 5,120,382 | A | 6/1992 | Weder | 156/212 |
| 5,152,100 | A | 10/1992 | Weder et al. | 47/72 |
| 5,181,364 | A | 1/1993 | Weder | 53/397 |
| D335,105 | S | 4/1993 | Ottenwalder et al. | D11/164 |
| 5,199,242 | A | 4/1993 | Weder et al. | 53/397 |
| 5,205,108 | A | 4/1993 | Weder et al. | 53/397 |
| 5,228,234 | A | 7/1993 | de Klerk et al. | 47/41.01 |
| 5,235,782 | A | 8/1993 | Landau | 47/72 |
| 5,239,775 | A | 8/1993 | Landau | 47/72 |
| 5,249,407 | A | 10/1993 | Stuck | 53/399 |
| 5,259,106 | A | 11/1993 | Weder et al. | 29/469.5 |
| 5,307,606 | A | 5/1994 | Weder | 53/410 |
| 5,315,785 | A | 5/1994 | Avôt et al. | 47/72 |
| 5,350,240 | A | 9/1994 | Billman et al. | 383/104 |
| 5,353,575 | A | 10/1994 | Stepanek | 53/461 |
| 5,361,482 | A | 11/1994 | Weder et al. | 29/469 |
| 5,388,695 | A | 2/1995 | Gilbert | 206/423 |
| 5,428,939 | A | 7/1995 | Weder et al. | 53/397 |
| 5,443,670 | A | 8/1995 | Landau | 156/101 |
| 5,493,809 | A | 2/1996 | Weder et al. | 47/72 |
| D368,025 | S | 3/1996 | Sekerak et al. | D9/305 |
| 5,496,251 | A | 3/1996 | Cheng | 493/224 |
| 5,496,252 | A | 3/1996 | Gilbert | 493/224 |
| 5,526,932 | A | 6/1996 | Weder | 206/423 |
| 5,551,570 | A | 9/1996 | Shaffer et al. | 206/575 |
| 5,572,849 | A | 11/1996 | Weder et al. | 53/399 |
| 5,572,851 | A | 11/1996 | Weder | 53/399 |
| 5,575,133 | A | 11/1996 | Weder et al. | 53/397 |
| 5,617,703 | A | 4/1997 | Weder | 53/413 |
| 5,624,320 | A | 4/1997 | Martinez | 472/51 |
| 5,625,979 | A | 5/1997 | Weder | |
| 5,647,168 | A | 7/1997 | Gilbert | 47/72 |
| 5,647,193 | A | 7/1997 | Weder et al. | 53/465 |
| 5,715,944 | A | 2/1998 | Windisch | 206/423 |
| D404,684 | S | 1/1999 | Shea | D11/164 |
| D419,436 | S | 1/2000 | Celtorius et al. | D9/305 |
| 6,129,209 | A | 10/2000 | Tchira | 206/423 |
| 6,182,395 | B1 * | 2/2001 | Weder et al. | 47/72 |
| 6,185,904 | B1 * | 2/2001 | Weder et al. | 47/72 |
| 6,230,441 | B1 * | 5/2001 | Weder et al. | 47/72 |
| 6,298,601 | B1 * | 10/2001 | Weder et al. | 47/72 |
| 2001/0000555 | A1 * | 5/2001 | Weder et al. | 47/72 |

FOREIGN PATENT DOCUMENTS

| | | |
|---|---|---|
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2610604 | 8/1988 |
| FR | 2603159 | 3/1989 |
| FR | 2619698 | 3/1989 |
| GB | 5605 | 5/1885 |
| GB | 1204647 | 9/1970 |

| | | |
|---|---|---|
| GB | 2056410 | 3/1981 |
| GB | 2074542 | 11/1981 |
| GB | 2128083 | 4/1984 |
| GB | 2252708 | 8/1992 |
| IT | 224507 | 4/1996 |
| JP | 542958 | 2/1993 |
| NL | 8301709 | 12/1984 |
| NL | 1000658 | 1/1996 |
| WO | 9315979 | 8/1993 |

OTHER PUBLICATIONS

"Speed Sheets and Speed Rolls" Brochure, Highland Supply Corporation, ©1990.
"Color Them Happy with Highlander Products" ©1992.
"Costa Keeps the Christmas Spirit", Supermarket Floral, Sep. 15, 1992.
"Super Seller", Supermarket Floral, Sep. 15, 1992.
"Halloween", Link Magazine, Sep. 1992.
"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve ™and Florasheer®, published prior to Mar. 31, 1994, 2 pages.
"Stand Alone Plastic Bagmaking" brochure, AMI, Atlanta, GA, Feb. 15, 1996, 2 pages.
"Foil Jackets" brochure, Custom Medallion, Inc., Dec., 1996, 2 pages.
"Derwent Abstract" of FR 2610604A. It is noted that the abstract is an incorrect English translation of the contents of the French patent. The French patent does not enable or disclose adhesively attaching the covering to the container. 1988.
"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase.
"Special Occasion Printed Highlophane Bags" Brochure, Highland Supply Corporation, 1990, 2 pages.
"Creative Packaging" Brochure, John Henry Company, Sep. 1992.
"Make Highlander Your Headquarters" Brochure, Highland Supply Corporation, 1991.

* cited by examiner

METHOD OF COVERING A POT OR FLORAL GROUPING WITH A SLEEVE HAVING A ROUNDED LOWER END

CROSS REFERENCE TO RELATED APPLICATIONS

The present application is a continuation-in-part of U.S. Ser. No. 09/401,771 filed Sep. 22, 1999, now U.S. Pat. No. 6,230,441, which is a continuation of U.S. Ser. No. 08/606,957, filed Feb. 26, 1996, now abandoned.

FIELD OF THE INVENTION

This invention generally relates to sleeves, and more particularly, to sleeves used to wrap floral groupings or flower pots containing floral groupings and/or mediums containing floral groupings, and methods of using same. U.S. Pat. Nos. 5,625,979 and 5,493,809 and pending U.S. Ser. No. 09/189,033 disclose subject matter which may be relevant to the invention contemplated and claimed herein and are hereby expressly incorporated herein by reference in their entirety.

DESCRIPTION OF THE PREFERRED EMBODIMENTS

Figure 1:
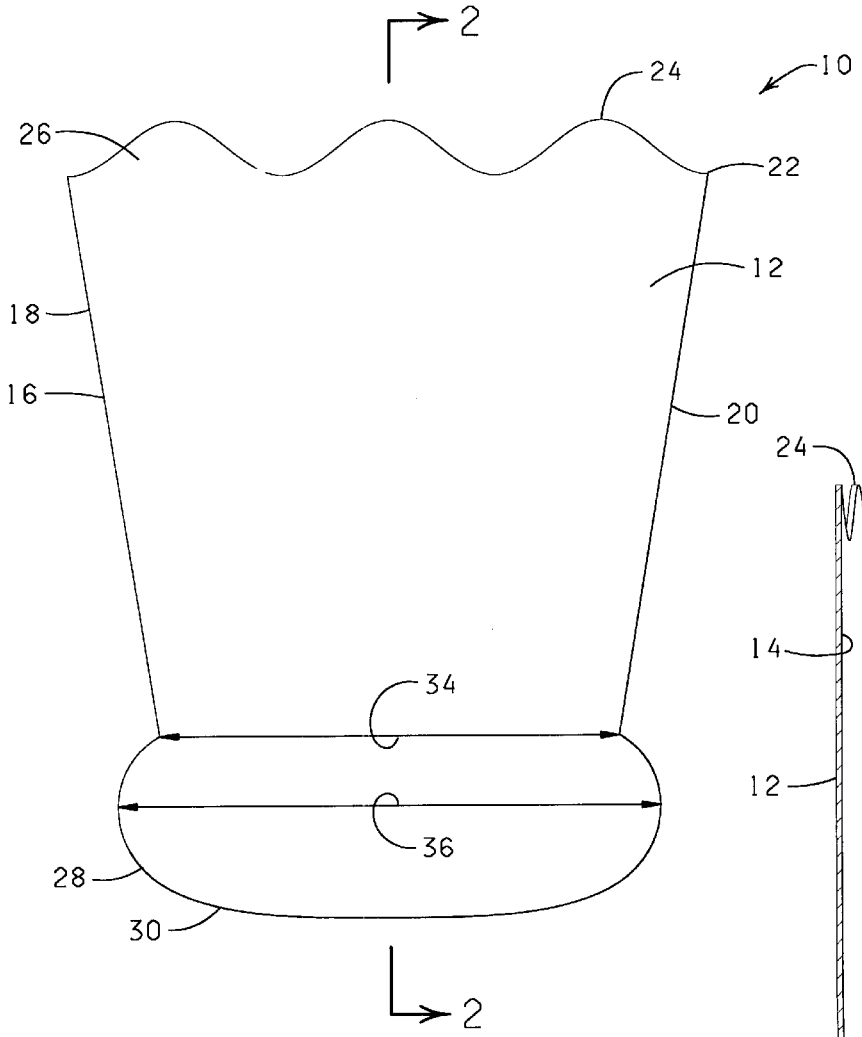
FIG. 1 is an elevational view of a sleeve constructed in accordance with the present invention.
Figure 2:
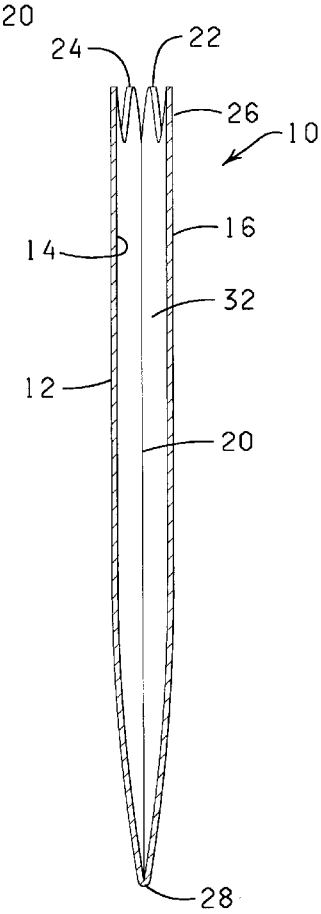
FIG. 2 is a cross-sectional view of the sleeve of FIG. 1 taken along line 2–2.
Figure 3:
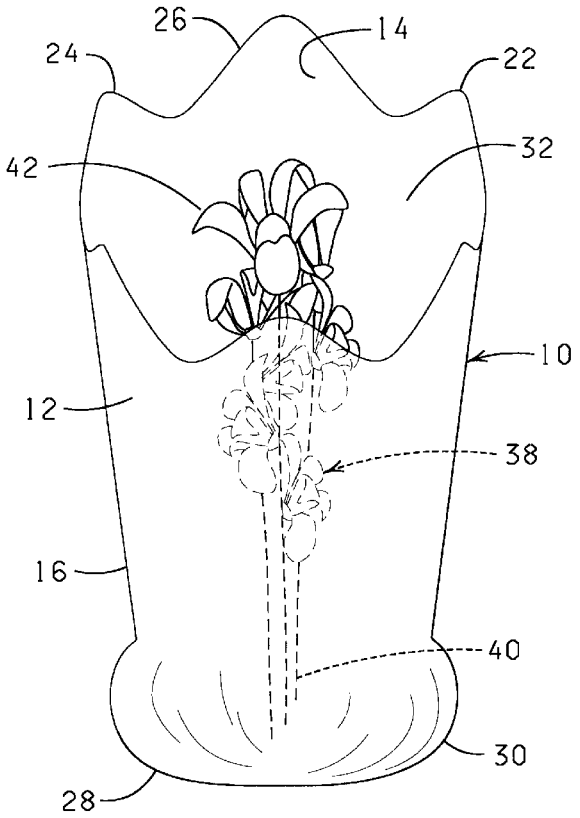
FIG. 3 is a perspective view of a sleeve such as the sleeve in FIG. 1 having a floral grouping therein.

The present invention contemplates in a preferred version a preformed sleeve (also referred to herein as a "floral sleeve" or simply as "a sleeve") having a tubular shape sized to contain and conform to a flower pot having an upper end, a lower end and an outer peripheral surface. The sleeve may further comprise a detachable upper portion which may be sized to surround and encompass a floral grouping.

The sleeve may form part of a plant package when used in conjunction with a floral grouping or a pot having a floral grouping therein, and wherein the pot and/or floral grouping is substantially surrounded and encompassed by the sleeve. The floral grouping is at least partially surrounded and encompassed and may be entirely enclosed by the upper portion when it forms a part of the sleeve.

Also, the sleeve may have a bonding material disposed on an inner portion thereof for bondingly connecting to a pot disposed therein. Alternatively, the bonding material may be disposed on an outer portion of the sleeve for forming a plurality of crimps in a portion of the sleeve.

When present, the lower portion of the sleeve may be constructed from a first material and the upper portion (when present) may be constructed from the first material or a second material different from the first material.

These embodiments and others of the present invention are now described in more detail below. It will be appreciated that the examples provided herein are not intended to limit the scope and extent of the claimed invention but are only intended to exemplify various embodiments of the invention contemplated herein.

Shown in FIGS. 1–4 is a sleeve designated by the general reference numeral 10. Sleeve 10 has an outer peripheral surface 12, an inner peripheral surface 14, a body 16, a first sidewall edge 18, a second sidewall edge 20, an upper end 22 having an upper edge 24, a skirt portion 26, a rounded lower end 28 having a rounded lower edge 30, and an inner space 32. The sleeve 10 has a minimum width 34 at a narrowest portion of the body 16, and the rounded lower end 28 has a maximum width 36 at a widest portion thereof. The minimum width 34 of the body 16 is less than the maximum width 36 of the rounded lower end 28. The shape of the rounded lower end 28 may be elliptical, circular, ovoid, or any other rounded shape known in the art. The sleeve 10 is preferably individually sized so that a standard sized flower pot, such as a 3-inch, 3 ½-inch, 4-inch, 4 ½-inch, 5-inch, 5 ½-inch, 6-inch, 6 ½-inch, 7-inch or 8-inch pot, for example, can fit within the sleeve 10, with the pot preferably substantially conforming to the inner peripheral surface 14 of the sleeve 10. The body 16 of the sleeve 10 preferably has a tapered, frustoconical shape, but may also have a rectangular or cylindrical shape. The sleeve 10 is initially formed to have a flattened condition and is openable therefrom to an open state for containing a floral container such as a pot as described elsewhere herein.

Figure 4:
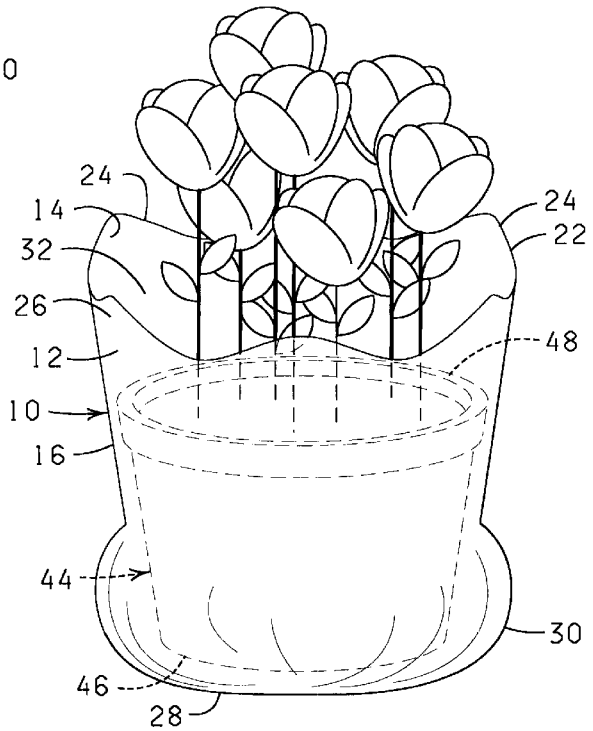
FIG. 4 is a perspective view of the sleeve of FIG. 1 having a pot and floral grouping therein.

In a preferred version of the invention shown in FIGS. 1–4 and the upper edge 24 of the upper end 22 of the sleeve 10 has a non-linear pattern such as a curve, wave, arc, or serration. The upper edge 24 and the upper end 22 form the skirt portion 26 of the sleeve 10 for decorating a floral grouping 38 having a stem portion 40 and a bloom portion 42 disposed therein (FIG. 3) or a pot 44 having a lower end 46 and an upper end 48 (FIG. 4). Other non-linear configurations of the upper edge 24 of the skirt portion 26 will be readily apparent to one of ordinary skill in the art, for example, those shown in FIGS. 11–16 of U.S. Ser. No. 09/401,771, the entire specification of which is hereby expressly incorporated herein by reference.

Figure 5:
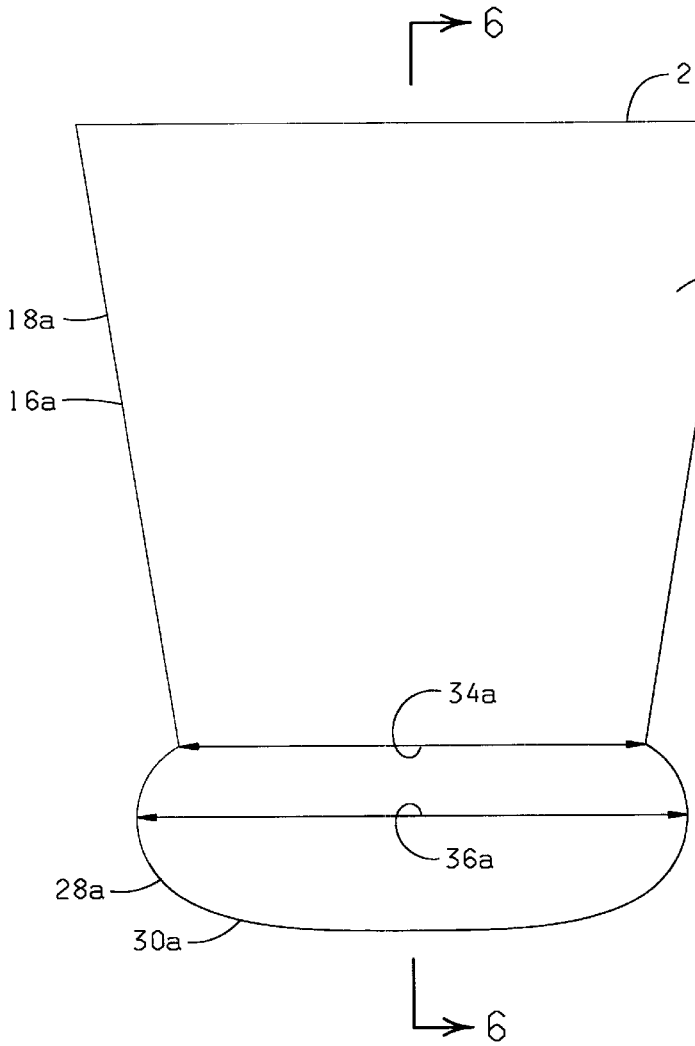
FIG. 5 is an elevational view of another embodiment of a sleeve constructed in accordance with the present invention.
Figure 6:
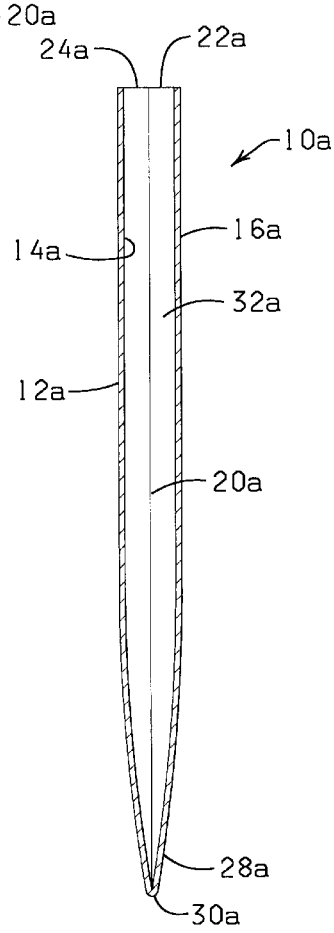
FIG. 6 is a cross-sectional view of the sleeve of FIG. 5 taken along line 6–6.

Shown in FIGS. 5–6 is a sleeve designated by the general reference numeral 10a. Sleeve 10*a* has an outer peripheral surface 12*a*, an inner peripheral surface 14*a*, a body 16*a*, a first sidewall edge 18*a*, a second sidewall edge 20*a*, an upper end 22*a* having an upper edge 24*a*, a rounded lower end 28*a* having a rounded lower edge 30*a*, and an inner space 32*a*. The sleeve 10*a* has a minimum width 34*a* at a narrowest portion of the body 16*a*, and the rounded lower end 28*a* has a maximum width 36*a* at a widest portion thereof. The minimum width 34*a* of the body 16*a* is less than the maximum width 36*a* of the rounded lower end 28*a*. Sleeve 10*a* differs from sleeve 10 shown above primarily in that the upper edge 24*a* of the upper end 22*a* is linear rather than non-linear.

Figure 7:
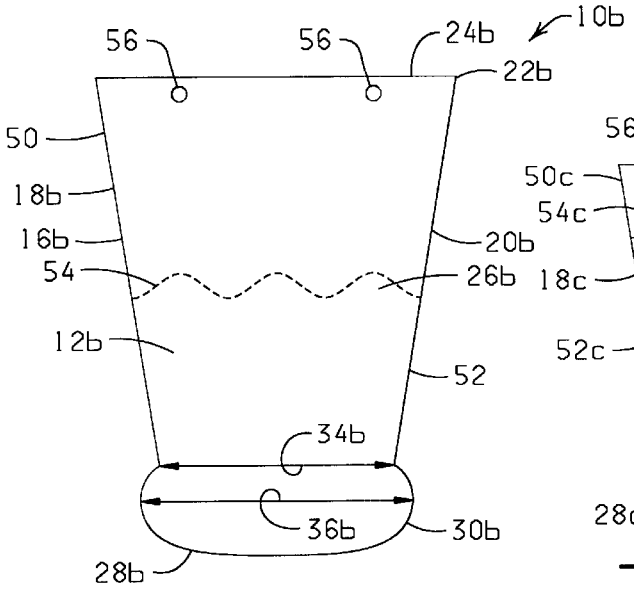
FIG. 7 is an elevational view of another embodiment of a sleeve constructed in accordance with the present invention.

Shown in FIG. 7 is a sleeve designated by the general reference numeral 10*b*. Sleeve 10*b* has an outer peripheral surface 12*b*, a body 16*b*, a first sidewall edge 18*b*, a second sidewall edge 20*b*, an upper end 22*b* having an upper edge 24*b*, a skirt portion 26*b*, and a rounded lower end 28*b* having a rounded lower edge 30*b*. The sleeve 10*b* has a minimum width 34*b* at a narrowest portion of the body 16*b*, and the rounded lower end 28*b* has a maximum width 36*b* at a widest portion thereof. The minimum width 34*b* of the body 16*b* is less than the maximum width 36*b* of the rounded lower end 28*b*.

Sleeve 10*b* is similar to sleeves 10–10*a* shown in FIGS. 1–6 except sleeve 10*b* comprises both an upper portion 50 and a lower portion 52. The upper portion 50 is detachable from the lower portion 52 via a detaching element 54, such as perforations. The upper portion 50 generally is sized so that it can substantially surround the floral grouping 38 when alone or when disposed within the pot 44 disposed within the sleeve 10*b*. The upper portion 50 may have apertures 56 therein for enabling the sleeve 10*b* to be supported from a support device or assembly such as a wicket, in a manner well known to those of ordinary skill in the art.

Figure 8:
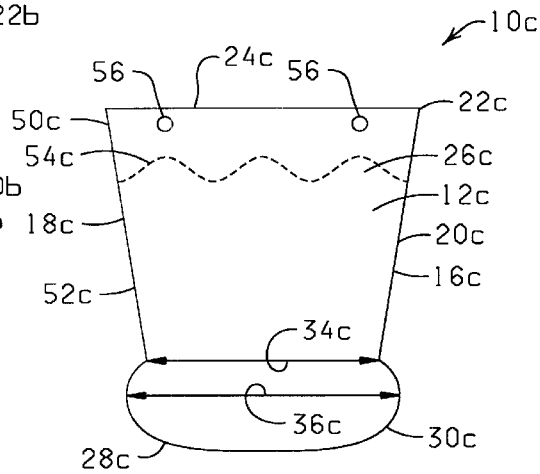
FIG. 8 is an elevational view of another embodiment of a sleeve constructed in accordance with the present invention.

Shown in FIG. 8 is a sleeve designated by the general reference numeral 10*c*. Sleeve 10*c* has an outer peripheral surface 12*c*, a body 16*c*, a first sidewall edge 18*c*, a second sidewall edge 20*c*, an upper end 22*c* having an upper edge 24*c*, a skirt portion 26*c*, and a rounded lower end 28*c* having a rounded lower edge 30*c*. The sleeve 10*c* has a minimum width 34*c* at a narrowest portion of the body 16*c*, and the rounded lower end 28*c* has a maximum width 36*c* at a widest portion thereof. The minimum width 34*c* of the body 16*c* is less than the maximum width 36*c* of the rounded lower end 28*c*.

Sleeve 10*c* is similar to sleeve 10*b* shown above in having an upper portion 50*c*, a lower portion 52*c*, a detaching element 54*c* and optionally, apertures 56, but differs in that the upper portion 50*c* is designed to be removed from the lower portion 52*c* before the lower portion 52*c* is used to cover pot 44 or a floral grouping 38 and further, the upper portion 50*c* is generally not sized to enclose the floral grouping 38.

Figure 9:
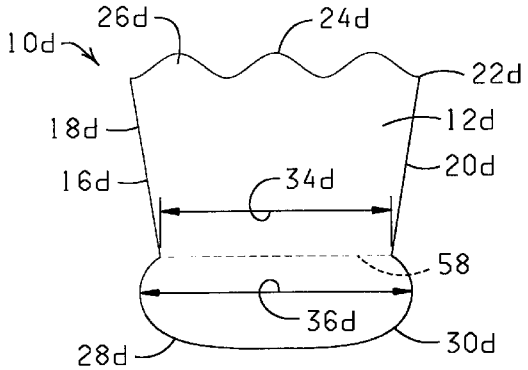
FIG. 9 is an elevational view of another embodiment of a sleeve constructed in accordance with the present invention.

Shown in FIG. 9 is a sleeve designated by the general reference numeral 10*d*. Sleeve 10*d* has an outer peripheral surface 12*d*, a body 16*d*, a first sidewall edge 18d, a second sidewall edge 20*d*, an upper end 22*d* having an upper edge 24*d*, a skirt portion 26*d*, and a rounded lower end 28d having a rounded lower edge 30*d*. The sleeve 10*d* has a minimum width 34*d* at a narrowest portion of the body 16*d*, and the rounded lower end 28*d* has a maximum width 36*d* at a widest portion thereof. The minimum width 34*d* of the body 16*d* is less than the maximum width 36*d* of the rounded lower end 28*d*.

Sleeve 10*d* is similar to sleeves 10–10*c* shown above except sleeve 10*d* has a gusset 58 in the lower end 28*d*. The gusset 58 further enables the lower end 28*d* to be expanded when the floral grouping 38 or pot 44 is disposed therein. Gussets and their construction are well known to persons of ordinary skill in the art, therefore further discussion of their methods of construction is not deemed necessary herein.

Figure 10:
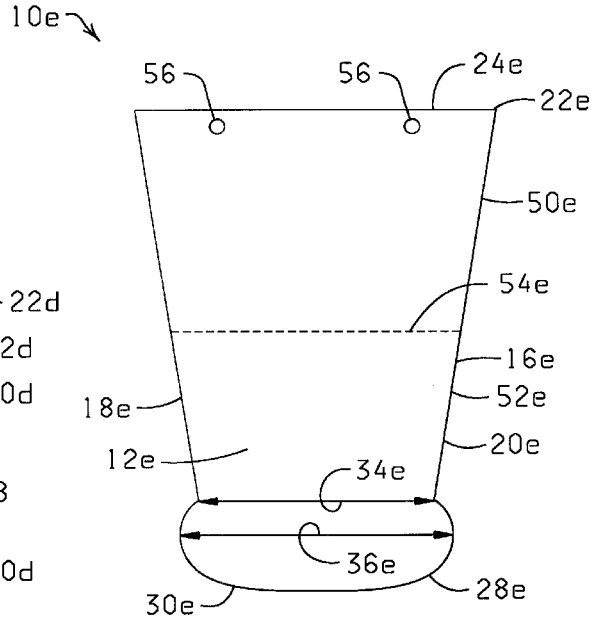
FIG. 10 is an elevational view of another embodiment of a sleeve constructed in accordance with the present invention.

Shown in FIG. 10 is a sleeve designated by the general reference numeral 10*e*. Sleeve 10*e* has an outer peripheral surface 12*e*, a body 16*e*, a first sidewall edge 18*e*, a second sidewall edge 20*e*, an upper end 22*e* having an upper edge 24*e*, and a rounded lower end 28*e* having a rounded lower edge 30*e*. The sleeve 10*e* has a minimum width 34*e* at a narrowest portion of the body 16*e*, and the rounded lower end 28*e* has a maximum width 36*e* at a widest portion thereof. The minimum width 34*e* of the body 16*e* is less than the maximum width 36*e* of the rounded lower end 28*e*.

Sleeve 10*e* is similar to sleeve 10*b* shown above. Sleeve 10*e* has an upper portion 50*e*, a lower portion 52*e*, and a detaching element 54*e* for detaching the upper portion 50*e* from the lower portion 52*e*. Sleeve 10*e* optionally has apertures 56 for enabling the sleeve 10*e* to be supported from a support assembly as described above. Sleeve 10*e* differs from sleeve 10*b* primarily in that the detaching element 54*e* has a linear or arcuate pattern extending from first sidewall edge 18*e* to second sidewall edge 20*e* rather than a non-linear pattern as shown for detaching element 54 of sleeve 10*b*.

Any of the sleeves contemplated herein may also be equipped with drainage elements (e.g., one or more holes) in the lower end 28–28*e* thereof or ventilation holes (not shown), or can be made from permeable or impermeable materials.

Any thickness of material may be utilized in accordance with the present invention as long as the sleeves may be formed as described herein, and as long as the formed sleeves may contain at least a portion of the pot 44 or floral grouping 38, as described herein. Additionally, an insulating material such as bubble film, preferable as one of two or more layers, can be utilized in order to provide additional protection for the item, such as the floral grouping 38, contained therein.

The material from which the sleeves 10–10*e* described herein are constructed preferably has a thickness in a range from about 0.1 mil to about 30 mils. Often, the thicknesses of the sleeves are in a range from about 0.5 mil to about 10 mils or preferably, in a range from about 1.0 mil to about 5 mils. More preferably, the sleeves 10–10*e* are constructed from a material which is flexible, semi-rigid, rigid, or any combination thereof. The sleeves 10–10*e* may be constructed of a single layer of material or a plurality of layers of the same or different types of materials. The layers of material comprising the sleeves 10–10*e* may be connected together or laminated or may be separate layers. Such materials used to construct the sleeves 10–10*e* are described in U.S. Pat. No. 5,111,637, which is hereby expressly incorporated herein by reference.

The sleeves 10–10*e* are constructed from any suitable material that is capable of being formed into a sleeve and wrapped about the pot 44 and the floral grouping 38 (or the floral grouping 38 alone) disposed therein. Preferably, the material comprises treated or untreated paper, metal foil, polymeric film, non-polymeric film, woven or nonwoven fabric, or synthetic or natural fabric, cardboard, fiber, cloth, burlap, or laminations or combinations thereof.

In one embodiment, the sleeves 10–10*e* contemplated herein may be constructed from sheets comprising two polypropylene films. The two polypropylene films comprising the sleeves 10–10*e* may be connected together or laminated or may be separate layers. In an alternative embodiment, the sleeves 10–10*e* may be constructed from only one sheet of the polypropylene film.

The term "polymeric film" means a synthetic polymer such as a polypropylene or a naturally occurring polymer such as cellophane. A polymer film is relatively strong and not as subject to tearing (substantially non-tearable), as might be the case with paper or foil.

The materials comprising the sleeves 10–10*e* may vary in color and as described herein may consist of designs or decorative patterns which are printed, etched, and/or embossed thereon using inks or other printing materials. An example of an ink which may be applied to the surface of the material is described in U.S. Pat. No. 5,147,706, which is hereby expressly incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination. Moreover, portions of the material used in constructing the sleeves 10–10*e* may vary in the combination of such characteristics. The material utilized for the sleeves 10–10*e* may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. As noted earlier, the floral grouping 38 comprises the bloom portion 42 and the stem portion 40. Further, the floral grouping 38 may comprise a growing potted plant having a root portion (not shown) as well. However, it will be appreciated that the floral grouping 38 may consist of only a single bloom or only foliage, or a botanical item, or a propagule. The term "floral grouping" may be used interchangeably herein with both the terms "floral arrangement". The term "potted plant" generally refers to the floral grouping 38 and the pot 44 along with a growing medium. The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as a bouquet or a floral grouping. The term "propagule" when used herein means any structure capable of being propagated or acting as an agent of reproduction including seeds, shoots, stems, runners, tubers, plants, leaves, roots, or spores.

In accordance with the present invention a bonding material (not shown) may optionally be disposed on a portion of any of the sleeves 10–10*e* described herein to attach each sleeve 10–10*e* to the pot 44 having the floral grouping 38 therein and disposed within the sleeve 10–10*e*. The bonding material may alternatively be a band, tie, string, ribbon, wire, tape, heat shrinkable material or other typing or banding device which may be constructed within or attached to the sleeve 10–10*e* before it is applied about the pot or floral grouping or may be provided only after the sleeve 10–10*e* is applied about the pot or floral grouping. A separate bonding material may also assist in closing or sealing the upper portion (when present) of the sleeve 10–10*e* or in adhering the sleeve 10–10*e* to the pot after the pot has been disposed therein. Examples of how a bonding material may be disposed on the sleeve are shown in U.S. Pat. Nos. 5,493,809 and 5,625,979, both of which are hereby expressly incorporated herein by reference in their entirety.

The term "detaching element" when used generally herein, means any element or device such as, but not limited to, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching element" known in the art, or any combination thereof, could be substituted therefore and/or used therewith.

The upper portion 50*b*, 50*c* or 50*e* of the sleeve 10*b*, 10*c* and 10*e*, respectively, may also have an additional substantial vertically disposed detaching element comprising a plurality of vertical perforations (not shown but well known in the art) for facilitating removal of the upper portion 50*b*, 50*c* or 50*e* thereof from the lower portion 52*b*, 52*c* or 52*e*, respectively.

As indicated above, it will be understood by a person of ordinary skill in the art that equipment and devices for forming floral sleeves are commercially available, and are well known to a person of ordinary skill in the art. Further detailed discussion of the construction of the sleeves described herein therefore is not deemed necessary. However, briefly, the sleeves described herein may be formed by intermittently advancing two separate webs, one or two webs preformed in the form of a tube, or a single web folded double and sealing the longitudinal sides and bottom portions of the two facing panels then cutting the sleeve thus formed from the webs or web. Machines which can form sleeves from such single webs or pairs of webs are well within the knowledge of one of ordinary skill in the art.

As noted above, any of the sleeves 10–10*e* contemplated herein may have lower ends 28–28*e* which are open or closed. When the lower end 28–28*e* is closed, the lower end 28–28*e* may have one or more gussets 58 as described elsewhere herein formed therein for allowing expansion of the lower end 28–28*e* when an object with a broad lower end such as the pot 44 is disposed therein. In another version, the sleeve 10–10*e* may comprise a flap (not shown) which can be folded over and sealed with a bonding material to close the sleeve 10–10*e*.

The term "pot" or "flower pot" as used herein refers to any type of container used for holding a floral grouping or plant, including vases. Examples of pots, used in accordance with the present invention include, but not by way of limitation, clay pots, wooden pots, plastic pots, pots made from natural and/or synthetic fibers, and/or any combination thereof. The pot 44 is adapted to receive the floral grouping 38 in a retaining space thereof. The floral grouping 38 may be disposed within the pot 44 along with a suitable growing medium described elsewhere herein, or other retaining medium, such as a floral foam. It will also be understood that the floral grouping 38, and any appropriate growing medium or other retaining medium, may be disposed in the sleeve 10–10*e* without the pot 44 for cultivating the floral grouping 38 or displaying the grown floral grouping 38 or botanical item.

It should also be noted that for all versions of sleeves described above which have a bonding material thereon, it may be desirable to have a release material or cover strip covering the adhesive or cohesive bonding material disposed on any portion of such sleeves for preventing the bonding material from bonding to another surface until such is desired. Further, in each of the cases described herein wherein a sleeve 10–10*e* is applied to the pot 44, the sleeve 10–10*e* may be applied thereto either by depositing the pot 44 downwardly into the opened sleeve 10–10*e*, or the sleeve 10–10*e* may be brought upwardly about the pot 44 from below the pot 44.

It should be further noted that various features of the versions of the present invention such as closure bonding areas, support apertures, handles or handle apertures, additional perforations, drainage elements, ventilation holes, combinations of material may be used alone or in combination as elements of any of the embodiments described above herein.

Changes may be made in the construction and the operation of the various components, elements and assemblies described herein or in the steps or the sequence of steps of the methods described herein without departing from the spirit and scope of the invention as defined in the following claims.

What is claimed is:

1. A method of covering a pot or floral grouping, comprising:

providing a sleeve initially having a flattened condition, the sleeve comprising:

a body, an outer peripheral surface, an inner peripheral surface, a first sidewall edge, a second sidewall edge, an upper end having an upper edge, a rounded lower end having a rounded lower edge, and an inner space, and the body having a minimum width at a narrowest portion of the body, and the rounded lower end having a maximum width at a widest portion of the rounded lower end, and wherein the minimum width of the body is less than the maximum width of the rounded lower end, and wherein the body has a generally frustoconical or cylindrical shape when opened from the flattened condition;

opening the sleeve to expose the inner space thereof; and disposing the pot or the floral grouping into the inner space of the sleeve.

2. The method of claim 1 wherein in the step of providing a sleeve, the rounded lower end of the sleeve has a shape which is elliptical, circular or ovoid.

3. The method of claim 1 wherein in the step of providing a sleeve, the sleeve has a gusset in the rounded lower end.

4. The method of claim 1 wherein in the step of providing a sleeve, wherein the body comprises an upper portion, a lower portion and a detaching element for detaching the upper portion of the body from the lower portion of the body.

5. The method of claim 4 wherein in the step of providing a sleeve, the detaching element of the sleeve comprises perforations.

6. The method of claim 4 wherein in the step of providing a sleeve, the detaching element of the sleeve has a non-linear pattern such that when the upper portion of the body is detached, the lower portion of the body is left with an upper end having a non-linear upper edge.

7. The method of claim 4 wherein in the step of providing a sleeve, the detaching element of the sleeve has a linear pattern such that when the upper portion of the body is detached, the lower portion of the body is left with an upper end having a linear upper edge.

8. The method of claim 4 wherein the upper portion of the body is sized to substantially surround and enclose the pot or floral grouping.

9. The method of claim 4 wherein the upper portion of the body is adapted to support the sleeve from a support element.

10. The method of claim 1 wherein in the step of providing a sleeve, the sleeve has a skirt portion.

11. The method of claim 1 wherein in the step of providing a sleeve, the upper end of the sleeve has a non-linear edge.

12. The method of claim 1 wherein in the step of providing a sleeve, the upper end of the sleeve has a linear edge.

13. A method of covering a pot or floral grouping, comprising:

providing a sleeve initially constructed in a flattened condition, the sleeve comprising:

a body, the body having an upper portion, a lower portion, and a detaching element for detaching the upper portion from the lower portion, an outer peripheral surface, an inner peripheral surface, a first sidewall edge, a second sidewall edge, an upper end having an upper edge, a rounded lower end having a rounded lower edge, and an inner space, and the body having a minimum width at a narrowest portion of the body, and the rounded lower end having a maximum width at a widest portion of the rounded lower end, and wherein the minimum width of the body is less than the maximum width of the rounded lower end and wherein the body has a generally frustoconical or cylindrical shape when opened from the flattened condition;

opening the sleeve to expose the inner space thereof; and disposing the pot or floral grouping into the inner space of the sleeve.

14. The method of claim 13 wherein in the step of providing a sleeve, the rounded lower end of the sleeve has a shape which is elliptical, circular or ovoid.

15. The method of claim 13 wherein in the step of providing a sleeve, the sleeve has a gusset in the rounded lower end.

16. The method of claim 13 wherein in the step of providing a sleeve, the detaching element of the sleeve comprises perforations.

17. The method of claim 13 wherein in the step of providing a sleeve, the detaching element of the sleeve has a non-linear pattern such that when the upper portion of the body is detached, the lower portion of the body is left with an upper end having a non-linear upper edge.

18. The method of claim 13 wherein in the step of providing a sleeve, the detaching element of the sleeve has a linear pattern such that when the upper portion of the body is detached, the lower portion of the body is left with an upper end having a linear upper edge.

19. The method of claim 13 wherein the upper portion of the body is sized to substantially surround and enclose the pot or floral grouping.

20. The method of claim 13 wherein the upper portion of the body is adapted to support the sleeve from a support element.

21. The method of claim 13 wherein in the step of providing a sleeve, the sleeve has a skirt portion.

* * * * *